United States Patent [19]

Yokoyama et al.

[11] Patent Number: 4,897,625

[45] Date of Patent: Jan. 30, 1990

[54] REMOTELY CONTROLLABLE CIRCUIT BREAKER

[75] Inventors: Youichi Yokoyama, Amagasaki; Hideya Kondo, Hirakata; Youichi Kunimoto, Osaka; Manabu Yano, Shijyonawate, all of Japan

[73] Assignee: Electric Power Research Institute, Inc., Palo Alto, Calif.

[21] Appl. No.: 295,315

[22] Filed: Jan. 9, 1989

[30] Foreign Application Priority Data

Jun. 9, 1988 [JP] Japan ..... 63-142556

[51] Int. Cl.[4] ..... H01H 75/00

[52] U.S. Cl. ..... 335/14; 335/20; 335/6

[58] Field of Search ..... 335/6, 14, 20, 172–174, 335/176, 35

[56] References Cited

U.S. PATENT DOCUMENTS

| | | | |
|---|---|---|---|
| Re. 32,882 | 3/1989 | Yokoyama et al. | 335/14 |
| 4,598,263 | 8/1986 | Heyne et al. . | |
| 4,604,596 | 8/1986 | Yokoyama et al. | 335/14 |
| 4,682,132 | 7/1987 | Belbel et al. . | |
| 4,700,160 | 10/1987 | Belbel et al. . | |

*Primary Examiner*—Gerald P. Tolin
*Assistant Examiner*—Lincoln Donovan
*Attorney, Agent, or Firm*—James P. Hillman

[57] ABSTRACT

A remotely controllable circuit breaker with an improved space saving structure comprises first and second movable contacts 11 and 12 which are held respectively on first and second contact arms 31 and 32 and are driven individually by a switching mechanism 20 including a manual handle 22 with a contact tripping capability and by a remote control signal responsive electromagnet 60. An L-shaped actuator 80 with a horizontal member 81 and a vertical member 83 is provided to operatively connect the second contact arm 32 to an axially movable core 63, the output member of the electromagnet 60. The actuator 80 is pivoted at its connection between the horizontal and vertical members 81 and 83 and carries the second contact arm 32 on its vertical member 83 for pivotal movement of the second contact arm 32 between operative and inoperative positions respectively enabling and disabling the contact closing. The electromagnet 60 is arranged in side-by-side relation to the switching mechanism 40 with the first and second contact arms 31 and 32 interposed therebetween. The actuator 80 is located in proximity to the electromagnet 60 with the vertical member 83 extending over the lengthwise dimension or the axial direction of the core 63 and with the horizontal member extending over the width dimension of the electromagnet 60 to thereby accommodate the substantial portion of the actuator 80 within the lengthwise and widthwise dimensions of the adjacently disposed electromagnet 60.

6 Claims, 14 Drawing Sheets

REMOTELY CONTROLLABLE CIRCUIT BREAKER

BACKGROUND OF THE INVENTION

1. Field of the Invention

The present invention is directed to a remotely controllable circuit breaker incorporating an electromagnet which responds to a remote control signal for closing and opening a breaker contact, and more particularly to such a remotely controllable circuit breaker with an improved space saving structure.

2. Description of the Prior Art

Remotely controllable circuit breakers using an electromagnet for closing and opening the breaker contact are well known in the art, for example, as disclosed in U.S. Pat. Nos. 4,598,263, 4,682,132, and 4,700,160. The prior art breakers include a pair of first and second movable contact arms carrying first and second contacts, respectively. The first contact arm is operatively connected to a manual switching mechanism for manual contact closing and opening, while the second contact arm is operatively connected to an electromagnet for contact closing and opening in response to a remote control signal. The second contact arm is in the form of L-shaped actuator with vertical and horizontal members and carries the second contact on its one member and has the other member connected to a movable part of the electromagnet. The L-shaped second contact arm is pivotally supported at the connection between the angled members for pivotal movement about a pivot axis as it is driven by the electromagnet. In the prior breakers, the L-shaped second contact arm is not intended to be disposed in a closely adjacent relation to the electromagnet and requires a relatively large mounting space in the vicinity of the electromagnet. That is, either or both of the vertical and horizontal members of the L-shaped second contact arm extend in a direction away from the electromagnet. Because of such space consuming structure, the prior breaker is difficult to be made compact enough to be installed as a replacement breaker of remote control capability for an existing breaker without such capability. Further, the space consuming structure is found particularly disadvantageous when the electromagnet of greater dimensions and therefore having an increased driving force is required within a limited space for reliable electromagnet actuation in response to a remote control signal.

SUMMARY OF THE INVENTION

The present invention eliminates the above insufficiency and provides an improved space saving structure for a remotely controllable circuit breaker. The breaker in accordance with the present invention comprises a housing and a breaker contact composed of first and second movable contacts. The first contact is carried on a first contact arm which is operatively connected to a switching mechanism to be driven thereby to move between an OFF position and an ON position. The second contact arm is carried at one end of a second contact arm which extends along the first contact arm in a generally parallel relation thereto. The switching mechanism comprises a manual handle for manually moving the first contact arm between the OFF position and the ON position and includes a trip means which acts to forcibly move the first contact arm to the OFF position upon the occurrence of an overcurrent condition. Also included in the breaker is an L-shaped actuator having a horizontal member and a vertical member and carrying the second contact arm on its vertical member. The L-shaped actuator is pivotally supported in the housing at a portion adjacent the connection between the horizontal and vertical members for pivotal movement between an operative position where the second contact is allowed to come into contact with the first contact in the ON position and an inoperative position where the second contact is kept away from the first contact. The breaker includes an electromagnet with an axially movable plunger which is energizeable by a remote control signal for driving the plunger in its axial direction. The plunger is connected to the horizontal member of the L-shaped armature so as to move the second contact arm between the operative and inoperative positions upon the energization and deenergization of the electromagnet. The electromagnet has its length and width dimensions respectively parallel and perpendicular to the axis of the plunger, and is disposed within the breaker housing in side-by-side relation to the switching mechanism with the first and second contact arms arranged therebetween. The L-shaped actuator is disposed in close proximity to the electromagnet with its horizontal and vertical members extending respectively over the width and length dimensions of the electromagnet such that the horizontal and vertical members have their substantial portions located respectively within the width and length dimensions of the electromagnet. With this arrangement, the L-shaped actuator can be neatly mounted in closely adjacent relation to the electromagnet and requires only a minimum mounting space around the electromagnet, giving rise to a very compact arrangement to the combination of the electromagnet and the L-shaped actuator and therefore providing a fairly compact design for the overall breaker structure.

Accordingly, it is a primary object of the present invention to provide a remotely controllable circuit breaker which is capable of being made compact enough to be utilized as a replacement breaker of remote control capability for an existing breaker without such capability.

In a preferred embodiment, the second contact arm is pivotally supported at a point intermediate its ends to the vertical member of the L-shaped actuator for limited pivotal movement relative to the vertical member. A spring is interposed between the second contact arm and the vertical member to bias the second contact arm to urge the second contact in the operative position in pressed contact with the first contact in the ON position for giving a suitable contact pressure therebetween. Since the second contact arm is allowed the limited pivotal movement relative to the L-shaped actuator, when an extreme overcurrent flows through the contacts the second contact arm can be repelled away from the first contact arm against the bias of the spring due to electromagnetic repulsion forces generated between the parallel first and second contact arms, assuring immediate contact separation well in advance of the subsequently occurring contact separation by tripping.

It is therefore another object of the present invention to provide a remotely controllable circuit breaker in which the second contact arm is supported to the L-shaped actuator in such a way as to effect immediate contact separation upon the occurrence of a very large overcurrent flowing through the circuit of the breaker.

The first contact arm is pivotally supported at its intermediate portion between the ends to pivot about a first pivot axis and is connected to the switching mechanism at its end opposite of the first pivot axis from the other end carrying the first contact. With this pivot support of the first contact arm at the intermediate along its length, the switch mechanism is given an increased design flexibility in determining a desired separation travel distance of the first contact in relation to a limited travel distance given by the switching mechanism to the opposite end of the first contact arm. Also, in the breaker of the present invention, a magnetic coil is included as overcurrent sensing means to have an axially movable release rod which extends through the coil to be magnetically coupled therewith and is engageable at its one end with the first contact arm. The magnetic coil is connected in the breaker circuit in series relation to the first and second contacts such that it magnetically drives the release rod in the direction of disengaging the first contact in the ON position from said second contact upon the occurrence of an excess amount of current flowing through the magnetic coil. This contact separation by the release rod is momentary and is followed by the tripped contact separation by the trip means. The release rod is connected to the first contact arm at a point between the first pivot axis and the first movable contact so that it can give a suitable separation travel distance effective for immediate contact separation, while its connection to the first contact arm can be spaced by a rather long distance along the length from the end of the first contact arm receiving a manual contact separating force from the switching mechanism. It is within this long distance afforded along the first contact arm that more parts of the switching mechanism can be arranged so as to make compact the switching mechanism including the magnetic coil and the release rod, particularly in the lengthwise direction of the first contact arm.

It is therefore a further object of the present invention to provide a remotely controllable circuit breaker in which the first contact arm can be effectively driven by the manual handle and also by an excess current responsive magnetic coil, yet providing a compact design to the switching mechanism including the overcurrent sensing magnetic coil.

In the present invention, there are disclosed still further advantageous features with regard to the mounting structure of an indicator which is movable together with the L-shaped actuator between two positions each indicative of each one of the operative and inoperative positions of the second contact arm, and also to the insulating structure between the electromagnet and the second contact arm and between the electromagnet and a conductor element for the connection of the second contact arm to a terminal on the exterior of the breaker housing.

These and still other objects and advantages will become apparent from the following description of the preferred embodiment of the present invention when taken in conjunction with the attached drawings.

DETAILED DESCRIPTION OF THE PREFERRED EMBODIMENT

Figure 1:
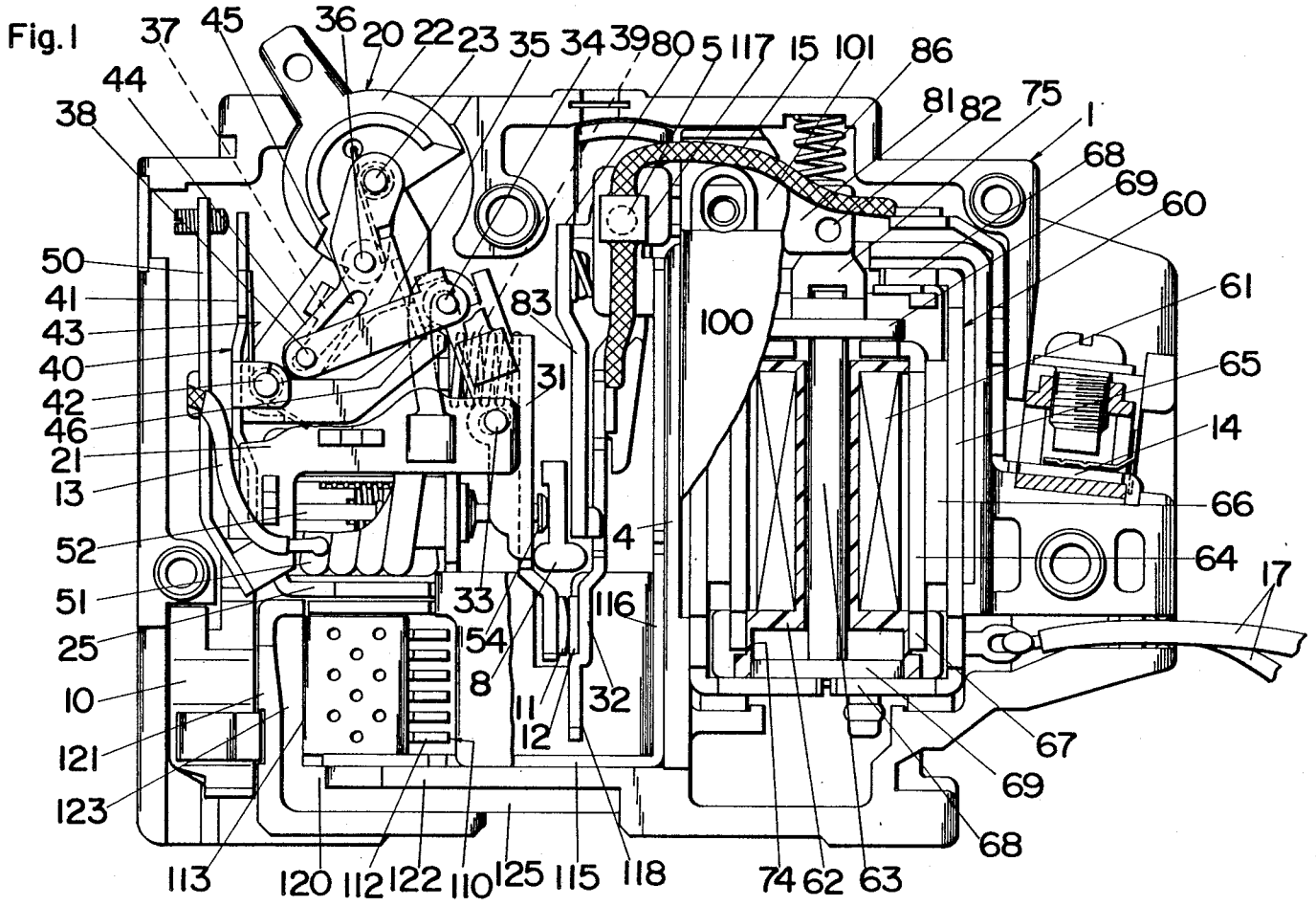
FIG. 1 is a vertical section of a remotely controllable circuit breaker in accordance with a preferred embodiment of the present invention.
Figure 2:
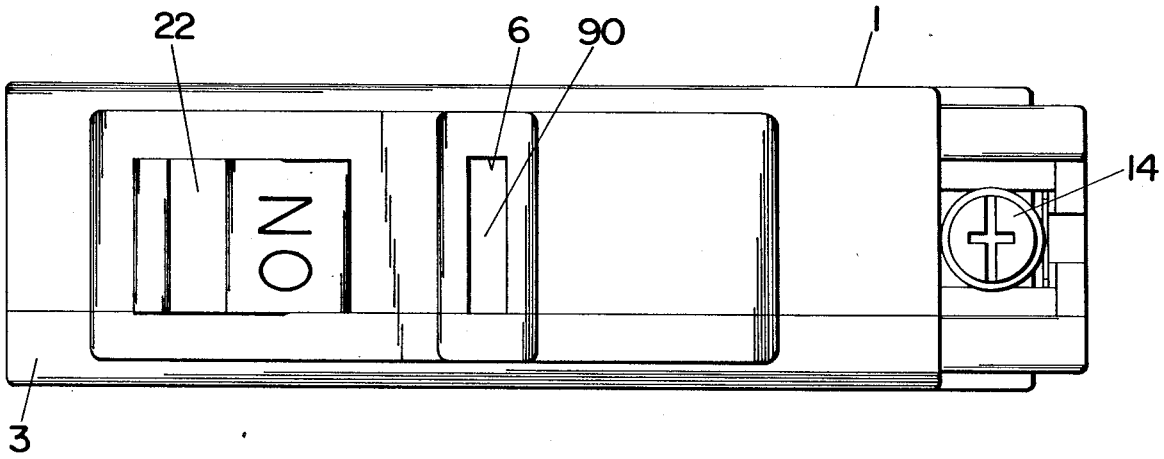
FIG. 2 is a top view of the breaker.
Figure 3:
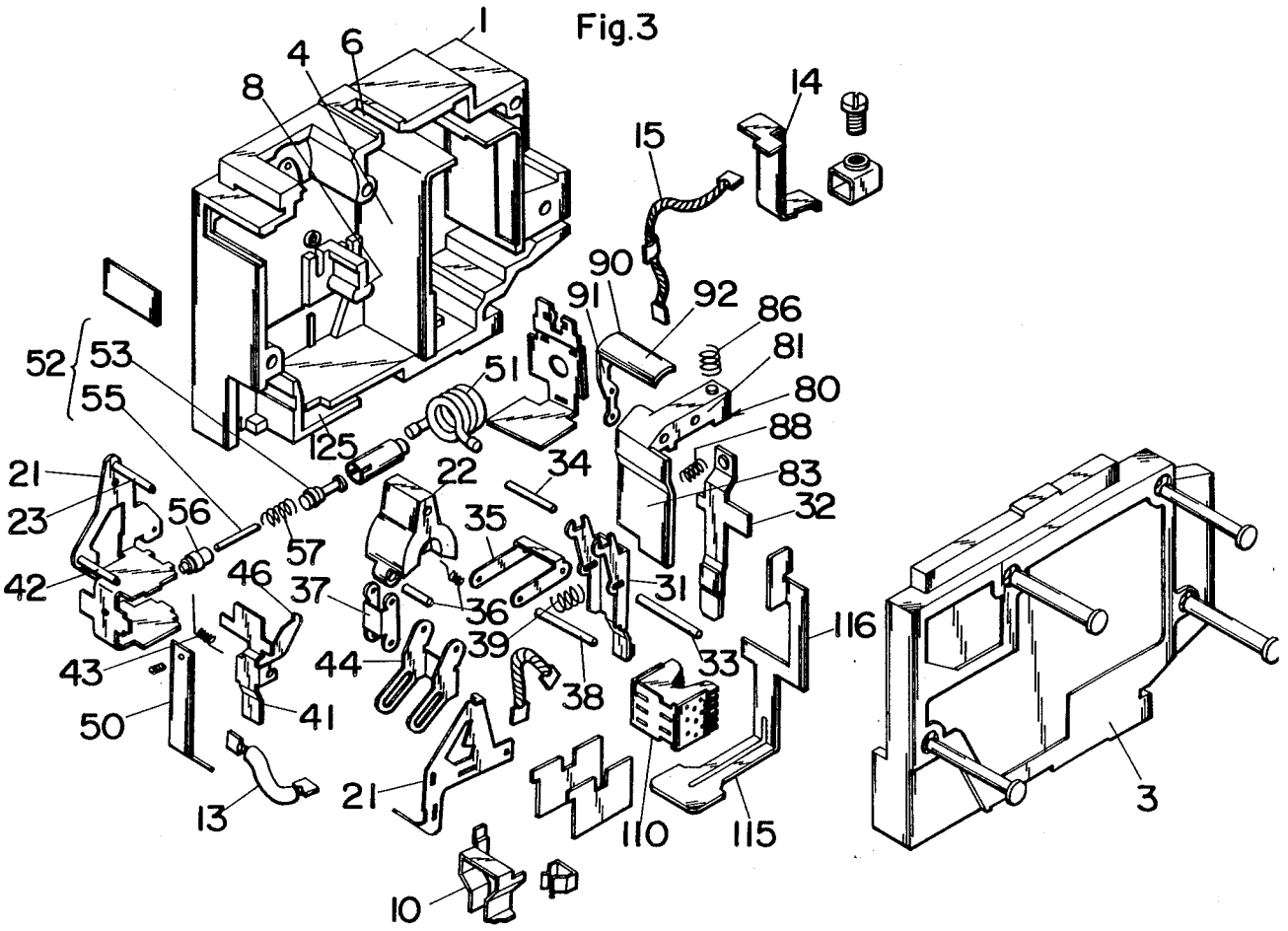
FIG. 3 is an exploded perspective view of the breaker.

Referring to FIGS. 1 to 3, a remotely controllable circuit breaker according to a preferred embodiment of the present invention is shown to comprise a housing 1 of electrically insulative material in which a manually operable switching mechanism 20 is provided to open and close a single set of first and second breaker contacts 11 and 12 by manipulation of a manual handle 22.

The housing 1 includes a side cover 3 and is separated by a partition 4 into two compartments, one for receiving the switching mechanism 20 and the other for receiving a remotely controllable electromagnet switch 60 which is responsive to a remote control signal fed from a location remote from the breaker for opening the contacts, such remote control responsive contact opening operation overriding the manual switching operation to forcibly open the contacts 11 and 12.

The switching mechanism 20 comprises a frame 21 pivotally supporting the manual handle 22 about a handle pivot 23 at the upper end and a first movable contact arm 31 about a pivot pin 33 at the right end of the frame 21. The first movable contact arm 31 carries at its lower end the first contact 11 and is electrically connected to a line terminal 10 at the left end of the housing 1 by Way of a braid 13, the frame 21, a bimetallic strip 50, and a magnetic coil 51. The second contact 12 is carried on the lower end of a second movable contact arm 32 extending vertically in generally parallel relation to the first contact arm 31 and electrically connected to a load terminal 14 at the right end of the housing 1 by Way of a braid 15. The first contact arm 31 is pivoted at the middle of its length by the pivot pin 33 and is connected at its upper end to the handle 22 by way of pivot links 35 and 37 so that it is movable between an OFF position and an ON position as the handle 22 is manipulated to pivot about the handle pivot 23. The first contact arm 31 has its upper end connected to the pivot link 35 by a pivot pin 34. In FIG. 1, the first contact arm 31 is shown in its ON position where it has the first contact 11 in contact with the second contact 21 and is held in this position against the bias of a compression spring 39 by the action of a toggle linkage formed by pivot connections at pins 23, 36, and 38. The linkage connecting the handle 22 and the first contact arm 31 in the present embodiment assures the contact closing in a delayed-make fashion and the contact opening in a quick-break fashion.

Included in the switching mechanism 20 is a trip mechanism 40 which Opens the contacts 11 and 12 upon occurrence of predetermined overload current conditions detected by the bimetallic strip 50 or by the magnetic coil 51 which is connected in series between the first contact arm 31 and the line terminal 10. The trip mechanism 40 includes a latch lever 41 pivotally supported on the frame 21 and a cradle link 44 pivoted at its upper end to the handle 22 by the handle pivot 23. The cradle link 44 has a slit 45 for guiding therealong the pin 38 connecting the pivot links 35 and 37, and is therefore urged by the spring 39 in a clockwise direction in the figure about the handle pivot 23. The cradle link 44 is kept latched at 46 by the end of the horizontal arm of the latch lever 41 and is held in the position against the bias of the spring 39. The latch lever 41 is pivotable about a pin 42 and is urged by a torsion spring 43 in the counterclockwise direction as viewed in the figures. The vertical arm of the latch lever 41 extends along the bimetallic strip 50 in abuttable relation thereto.

Figure 11:
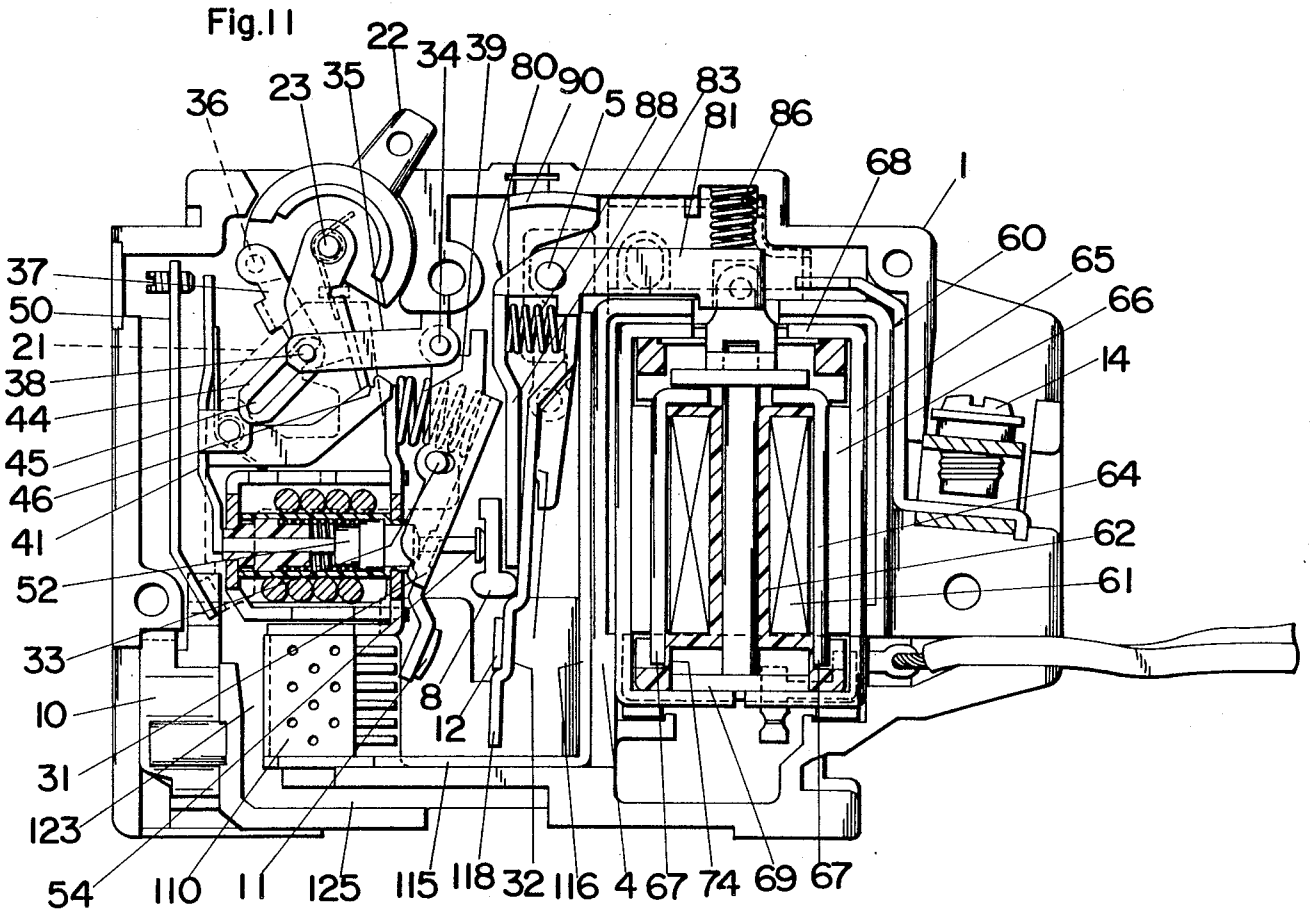
Figure 12:
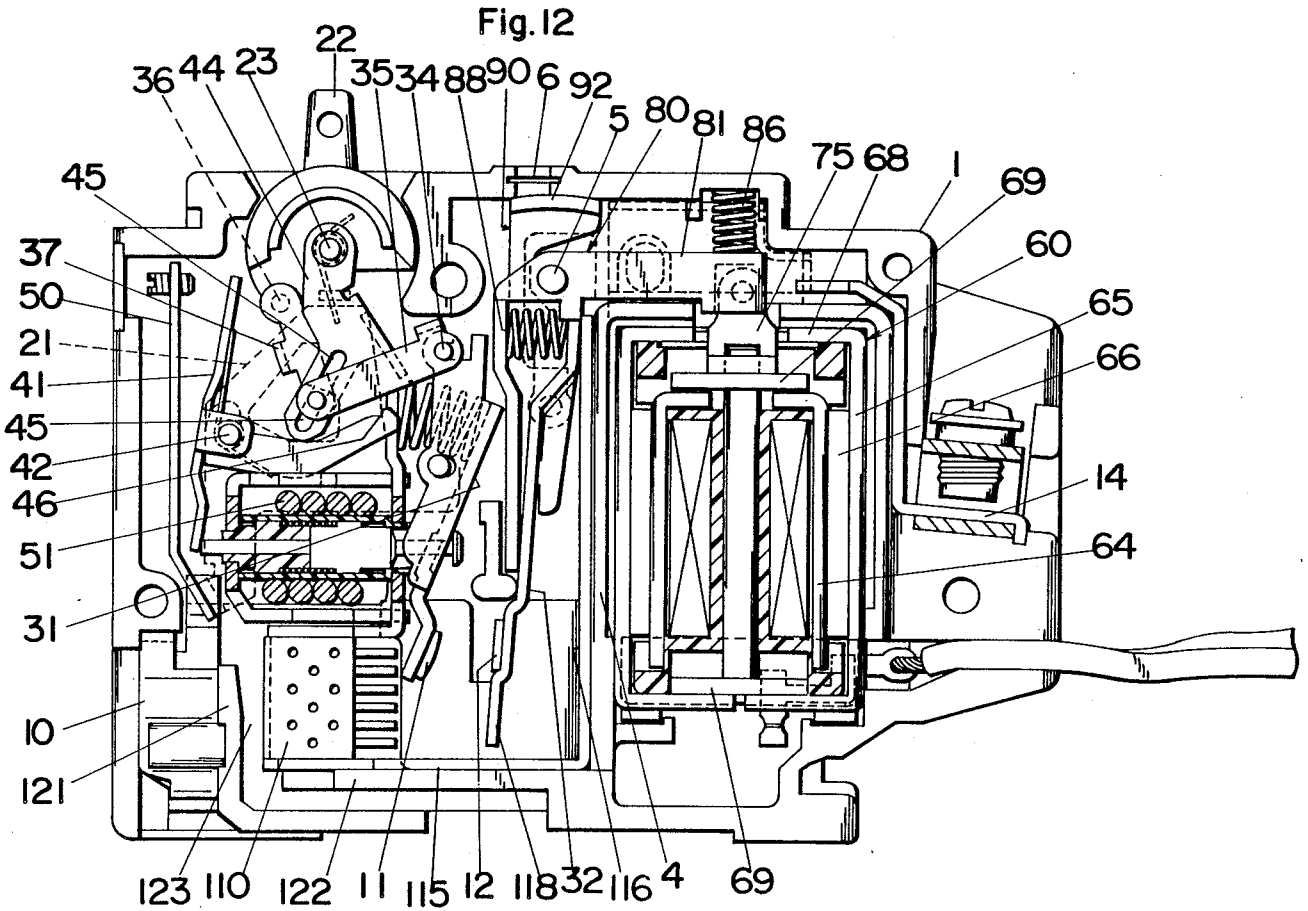
Figure 13:
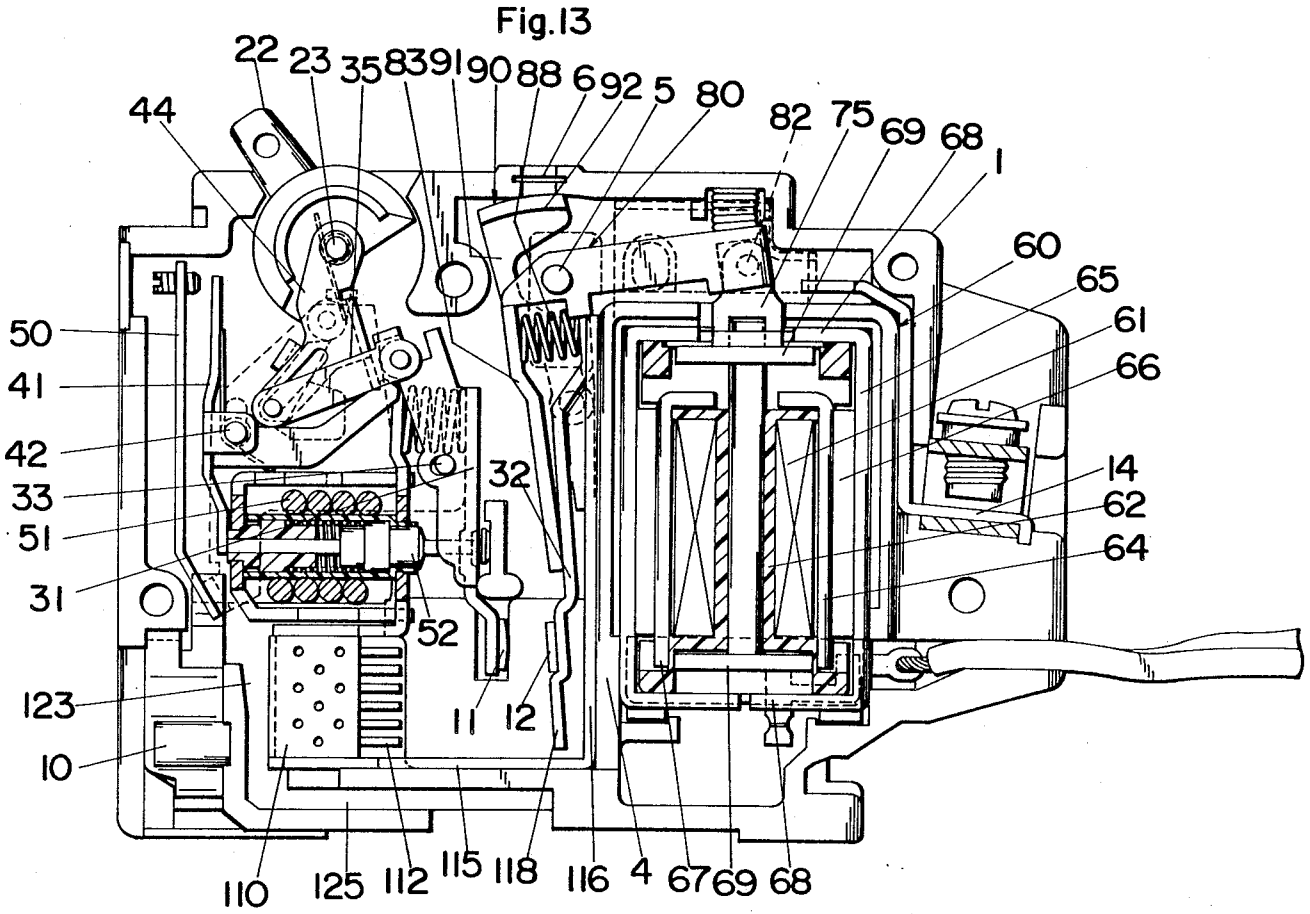

When the bimetallic strip 50 sees an overcurrent, it is deflected toward the vertical arm of the latch lever 41 to force the same to pivot in the clockwise direction, thus unlatching the cradle link 44. Upon this occurrence, the cradle link 44 is urged by the spring 39 to pivot in the counterclockwise direction to thereby pull the pin 38 retained in the slit 45 to the right, as seen in FIG. 11, thus forcing the first contact arm 31 to pivot about the pin 33 from the ON position to the OFF position.

The magnetic coil 51 includes a release rod 52 which extends therethrough to be axially movable. As shown in FIG. 3, the release rod 52 comprises a movable core 53 biased by a spring 57 away from a fixed core 56 at one end of the coil 51 and has at its one end a catch 54 for engagement with the first contact arm 31. The release rod 52 also includes a drive pin 55 extending through a fixed core 56 to be abuttable against the lower end of the vertical arm of the latch lever 41. Upon the occurrence of an extreme overcurrent flowing through the circuit, the magnetic coil $1 is magnetized to thereby attract the movable core 53 towards the fixed core 56. At this time, the first contact arm 31 is pulled by the catch 54 of the movable core 53 to be forcibly disengaged from the second contact arm 32 for immediate contact separation. Also at the same time, the drive pin 55 is pushed by the movable core 53 to strike the lower end of latch lever 41, thus pivoting the latch lever 41 to unlatch the cradle link 44, after which the same tripping action is performed as initiated by the bimetallic strip 50 to keep the contacts opened until they are reset by the manipulation of the handle 22. In this manner, the contact separation effected by directly pulling the first contact arm 31 always precedes the contact separation by the trip action and therefore assures an immediate contact separation for protecting the load circuit from an extreme overcurrent condition. It is noted at this point that the first contact arm 31 is connected to the release rod 52 at a point opposite of the pivot axis 33 from the upper effort point 34 receiving the forces from the handle 22 as well as from the trip mechanism 40. With this structure, the release rod 52 Can give an enough contact separation travel distance equivalent to that effected by the handle movement and the tripping action, yet allowing the magnetic coil 51 to be spaced from the effort point 35 along the length of the first contact arm 31 to such an extent as to accommodate Within that length the parts or the portion of the switching mechanism 20. Thus, the switching mechanism 20 including the magnetic coil 51 can be made in a compact arrangement While retaining the immediate and reliable contact separation by the magnetic coil 51.

The second contact arm 32 is connected through an L-shaped actuator so to the remotely controllable electromagnet switch 60 to be driven thereby to move between an operative position where the second contact 12 is engageable with the first contact 11 and an inoperative or disable position where the second contact 12 is inhibited from engaging with the first contact 11 irrespective of the condition of the manually switching mechanism 20. The electromagnet switch 60 is activated in response to a remote control signal fed from a remote station through lines 17. In the present embodiment, the electromagnet switch 60 is a polarized electromagnet of monostable type which keeps the second contact 12 in the operative position of FIG. 1 in the deenergized condition and moves the second contact 12, upon being energized, to the inoperative position to disable a load connected to the breaker.

Figure 4:
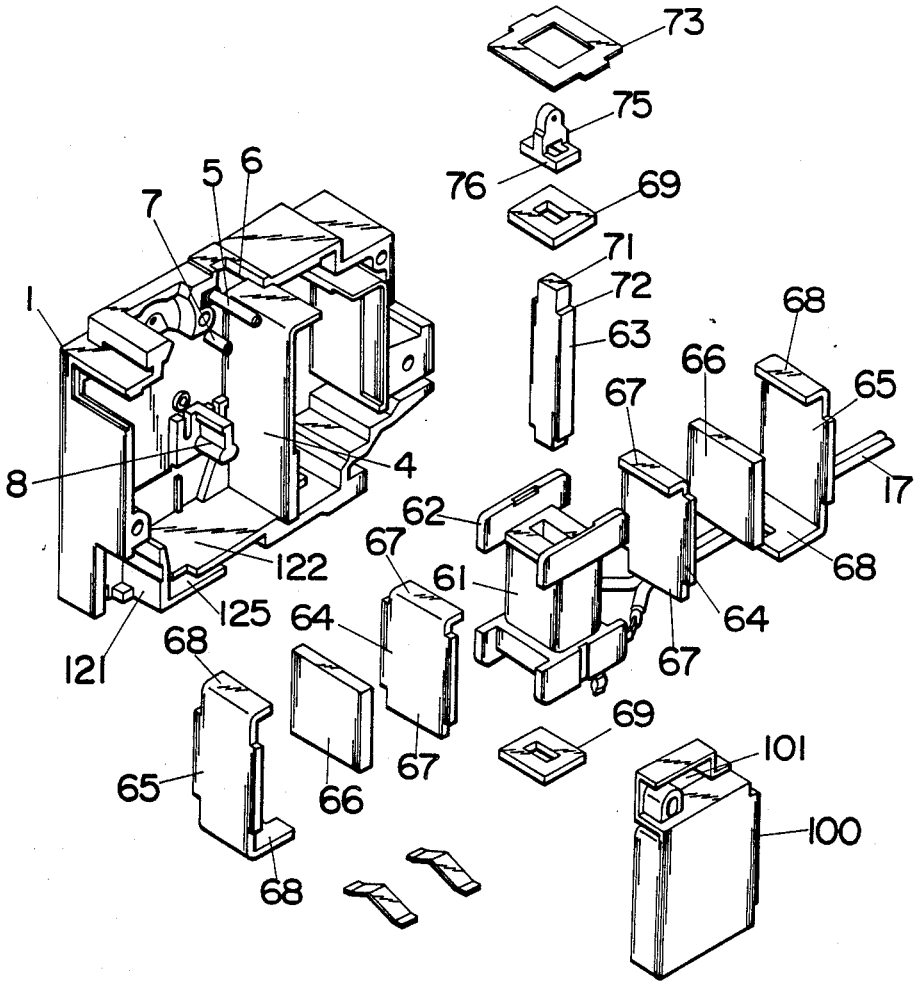
FIG. 4 is an exploded perspective view of an electromagnet employed in the breaker.

The electromagnet switch 60 comprises, as best shown in FIGS. 1 and 4, an excitation coil 61 wound around a bobbin 62, an axially movable plunger core 63 extending through the bobbin 62, paired inner yokes 64, paired outer yokes 65, and permanent magnets 66 each interposed between the inner and outer yokes 64 and 65 to magnetize them in the opposite polarity. The inner and outer yokes 64 and 65 define inner and outer pole ends 67 and 68 respectively at the upper and lower ends thereof, and extend outwardly of the excitation coil 61 in parallel with the axis thereof so as to form magnetic gaps between the adjacent inner and outer pole ends 67 and 68. Provided respectively at the upper and lower ends of the plunger core 63 are pole plates 69 each located between the magnetic gaps. The outer pole ends 68 at the upper and lower ends of the outer yoke 65 are bent at a right angle to form flanged pole ends to be abuttable with the corresponding one of the upper and lower pole plates 69. The inner pole end 67 is bent at a right angle only at the upper end of the inner yoke 64 to form a flanged pole end for abutment with the upper pole plate 69, while the inner pole end 67 at the lower end is spaced laterally outwardly from the pole plate 69 to form therebetween a constant air gap so that the plunger core 63 is stable at the position of FIG. 1 in which the upper and lower pole plates 69 are respectively in contact with the upper inner pole ends 67 and the lower outer pole ends 68 to complete the circuit of the magnetic flux emanating from the permanent magnets 66.

When the excitation coil 61 is energized by the control signal of a given polarity, the plunger core 63 is magnetized in the direction opposing the magnetic flux by the permanent magnets 66 to be thereby driven to move axially upwardly. The upper end of the plunger core 63 is connected to the L-shaped actuator 80 carrying the second contact arm 32 so that upon energization of the electromagnet 60 the upward movement of the plunger core 63 is transmitted to the second contact arm 32 to move the same into the inoperative position for opening the breaker circuit. In this position, the pole plate 69 at the upper end of the plunger core 63 abuts through a residual plate 73 against the flanged outer pole ends 68 at the upper ends of the outer yokes 65. Upon deenergization of the electromagnet 60, the plunger core 63 moves downwardly back to its stable position by the help of a return spring 86 acting on the connection between the plunger core 63 and the actuator 80, bringing the second contact arm 32 back into the operative position. The electromagnet switch 60 thus constructed is received within a cavity surrounded by the partition 4 with a joint 75 at the upper end of the plunger core 63 extending upwardly through the partition 4.

Figure 6:
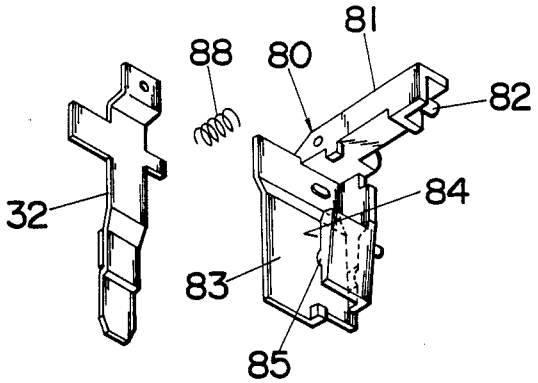
FIG. 6 is an exploded perspective view of an L-shaped actuator and a second contact arm employed in the breaker.

The L-shaped actuator so is made of electrically insulative material with a horizontal member 81 and a vertical member 83, and is mounted in the housing 1 outwardly of the partition 4 with its connection between the members 81 and 83 pivotally supported about a pivot post 5 integral With the housing 1. The horizontal member 81 extends over the Width dimension of the electromagnet switch 60 and is connected at its free end by an integral pin 82 to the joint 7S at the upper end of the plunger core 63. The spring 86 biasing the plunger core 63 to its stable position is held between the end of the horizontal member 81 and the upper wall of the housing 1. The vertical member 83 likewise extends over the length dimension of the electromagnet switch 60 and carries the second contact arm 32 for movement thereof between the operative and inoperative positions. As shown in FIG. 6, the upper half portion of the second contact arm 32 is held within a slit 84 of the vertical member 83 with its lengthwise center abutting against a fulcrum projection 85 in the slit 84 and with a compression spring 88 interposed between the upper end of the second contact arm 32 and the vertical member 83. Thus, the second contact arm 32 is allowed to pivot about the fulcrum projection 85 to a limited extent relative to the vertical member 83 against the bias of the spring 88. This is contemplated to effect a rapid contact separation on the side of the second contact arm 32 in case of an extreme overcurrent flowing through the circuit. That is, the second contact arm 32 will be instantly driven to move away from the first contact arm 31 while the actuator so is kept stationary due to the electromagnetic repulsion forces acting between the first and second contact arms 31 and 32 extending in parallel relation to each other and seeing such extreme overcurrent, enabling prompt contact separation in advance of the contact separation by the tripping mechanism 40 for safely protecting the load. A stop 8 projects integrally from the housing 1 for abutment respectively with the fist and second contact arms 31 and 32 upwardly of the first and second contacts 11 and 12.

Figure 7:
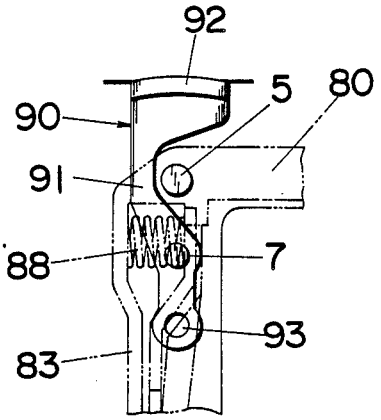
FIG. 7 is a partial view showing the mounting of an operation indicator in relation to the L-shaped actuator in the breaker.

An indicator 90 is mounted adjacent the actuator 80 to be pivotable together therewith between two angled positions indicative of the operative and inoperative positions of the second contact arm 32. The indicator 90 comprises a lever 91 extending in an overlying relation to the vertical member 83 of the actuator 80 and a display section 92 at the upper end of the lever 91. The display section 92 may be provided with markings for the inoperative and operative positions of the second contact arm 32 which can be viewed through a window 6 in the upper wall of the housing 1. As shown in FIG. 7, the lever 91 is pivoted at a pivot pin 7 spaced downwardly from the pivot axis 5 for the actuator 80 and is connected at its lower end 93 to the vertical member 83 of the actuator 80 in order to obtain a greater lever ratio for obtaining a sufficient amount of angular displacement of the display section 92 which is required for the changeover of the marking to be viewed through the window 6.

Figure 5:
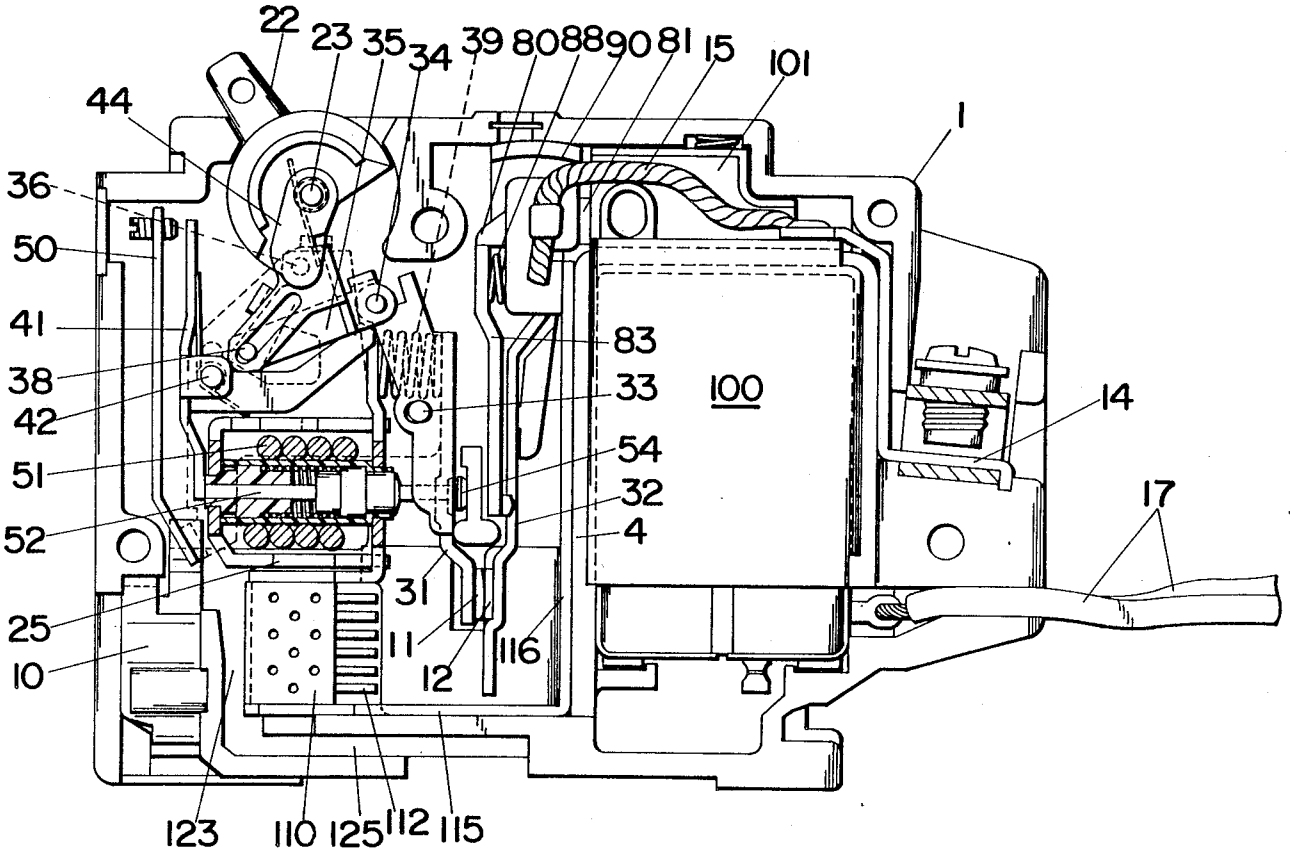
FIG. 5 is a vertical section of the breaker showing a protecting cover for the electromagnet.

As shown in FIGS. 4 and 5, a protective cover 100 of electrically and magnetically insulating material is provided to fit within the confines of the partition 4 over the electromagnet 60, completely insulating the electromagnet 60 from the adjacently disposed second contact arm 32 and the load terminal 14, and further from an arc drive member 116 extending along the outer vertical surface of the partition 4 in parallel With the second contact arm 32. The details of the arc drive member 116 will be discussed hereinafter with regard to an arc extinction mechanism. Integrally extending upwardly from the protective Cover 100 is a grooved flange 101 which extends beyond the partition 4 to be fitted within the upper wall of the housing 1 and the upper end wall of the partition 4 in an overlying relation to the horizontal member 81 of the L-shaped actuator 80. It is within this grooved flange 101 that the braid 15 interconnecting the second contact arm 32 and the load terminal 14 is received so that it is also completely insulated from the electromagnet 60.

Figure 9:
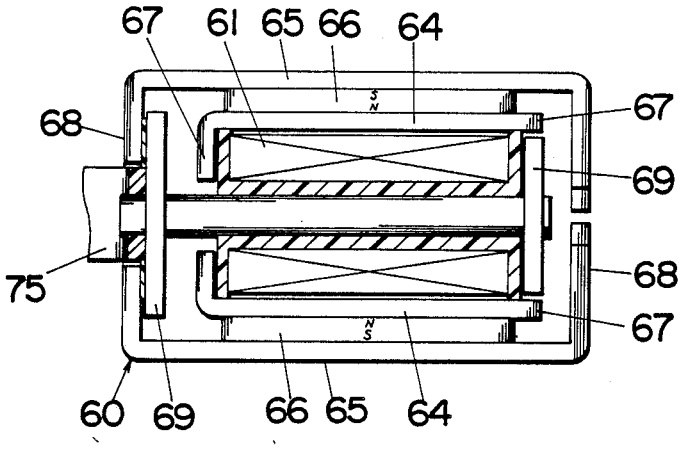
FIGS. 8 and 9 are explanatory views respectively showing the operation of the electromagnet.
Figure 8:
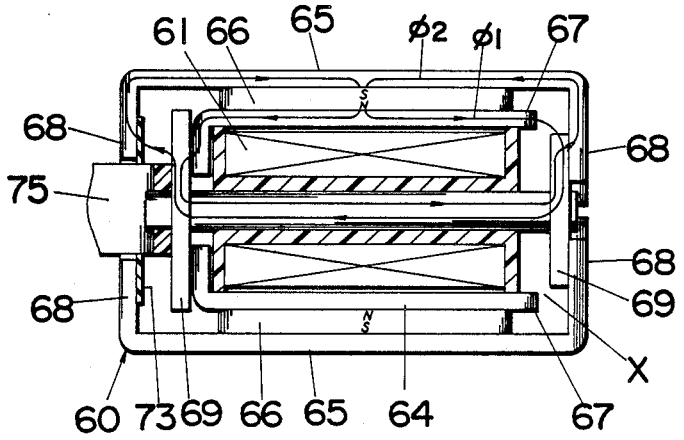
Figure 10:
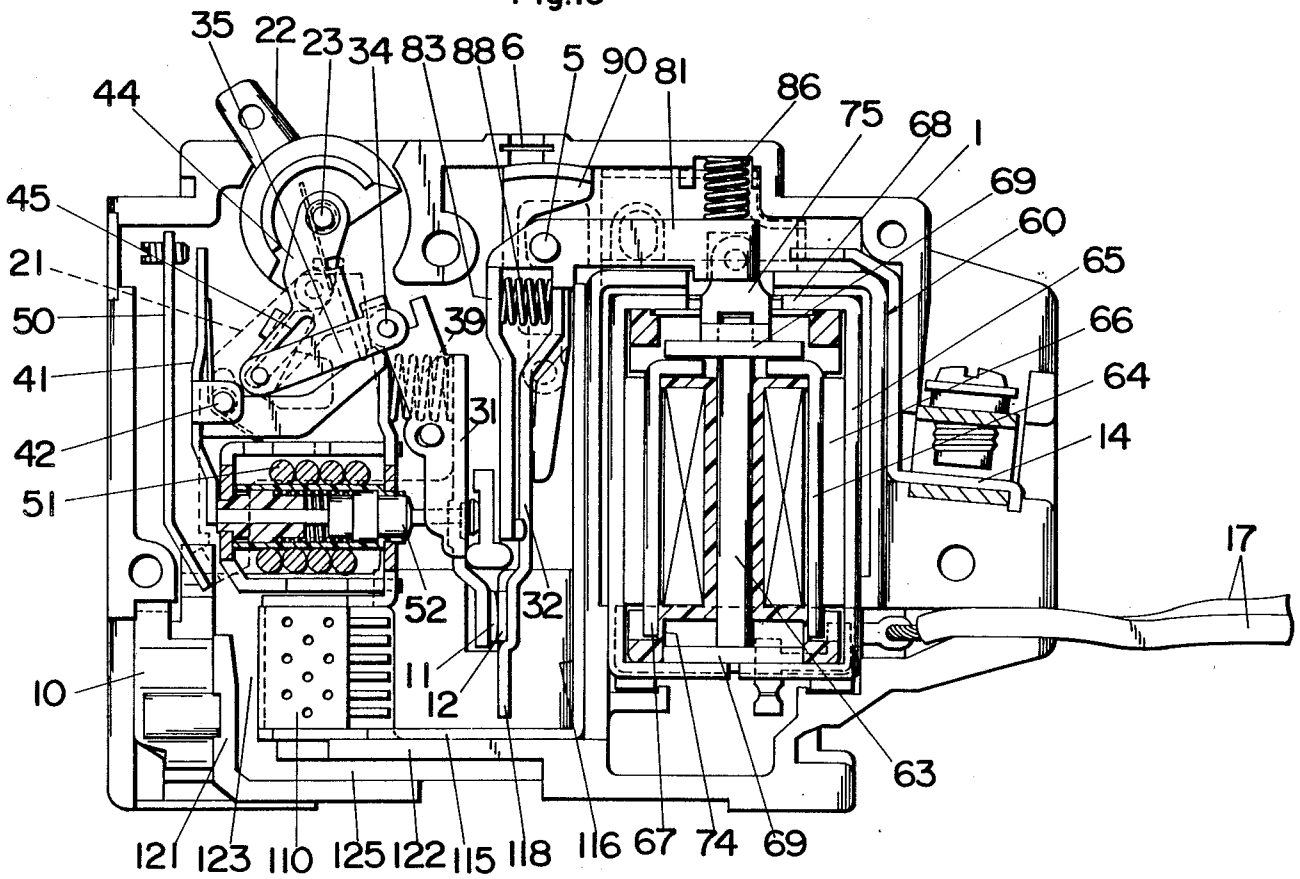
FIGS. 10 to 13 are respectively vertical sections illustrating various operating modes of the breaker.

Now referring to FIGS. 8 and 9, the electromagnet switch 60 will be discussed with its characterizing feature for improved response sensitivity to the control signal or reliable plunger movement upon the energization of the excitation coil 61. The electromagnet is characterized in that the inner pole end 67 at the lower end of each inner yoke 64 extends straight to define thereat a pole tip that is laterally spaced from the vertical plane in which the lateral edge of the adjacent pole plate 69 travels as the plunger core 63 moves axially in response to the energization and deenergization of the excitation coil 61. With this result, the pole tip 67 is permitted to extend over the lateral side of the adjacent pole plate 69 in its attracted position to the inner yokes 64 [FIG. 9] in order to reduce the gap or magnetic resistance between the pole tip 67 and the adjacent pole plate 69 in its attracted position to the outer yokes 65 [FIG. 10] while retaining a desired plunger stroke and without interference with the movement of the pole plate 69. Consequently, when the excitation coil 61 is energized to produce in the magnetic circuit a magnetic flux $\phi 1$ opposing the magnetic flux $\phi 2$ by the permanent magnet 66, the magnetic flux $\phi 1$ will pass through thus reduced gap X, or reduced magnetic resistance between the pole tip 67 and the adjacent pole plate 69, thereby increasing a magnetic attraction force acting on the plunger core 63 to move it axially upwardly to the position of FIG. 9 from the position of FIG. 10. In other words, the plunger core 63 can have an improved response sensitively to the energization of the excitation coil 61, or the remote control signal.

For achieving a smooth movement of the pole plate 69 in relation to the pole tips 67 of the inner yokes 64, the coil bobbin 62 is formed with a thin-walled guide segment 74 extending integrally from the lower flanged portion thereof into the clearance between the pole tip 67 and the lateral face of the adjacent pole plate 69. The guide segment 74 defines on its inner surface a smoothly finished guide surface along which the lateral edge of the adjacent pole plate 69 will be guided as the plunger core 62 is driven to move axially.

Figure 20:
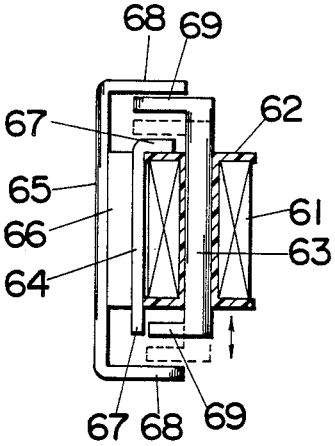
FIGS. 20 to 22 are respectively schematic views showing modified structures of the electromagnet.

Although the electromagnet 60 in the present invention is configured to be symmetrical with respect to the axis of the plunger core 63, it is equally possible to arrange an inner yoke 64, an outer yoke 65, a permanent magnet 66, and pole plates 69 on the one lateral side of the plunger core 63, as shown in FIG. 20.

Figure 21:
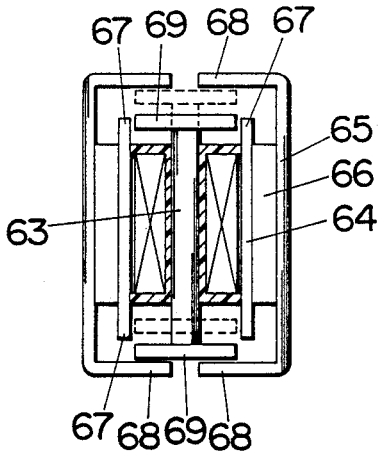
Figure 22:
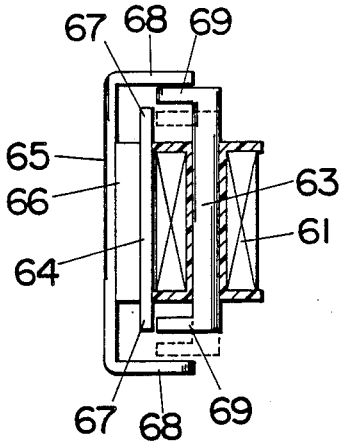

Further, the breaker of the present invention may utilize as a remote control switch means an electromagnet of bistable type, as shown in FIGS. 21 and 22, which holds the second contact at either of the inoperative and operative positions and switches the positions by receiving control signal of opposite polarities. In these modifications of FIGS. 21 and 22, the same scheme is applied to increase response sensitivity of the plunger core 63B, 63C to the energization of the excitation coil 61B, 61C by adopting the like arrangement that the inner yoke 64B, 64 C has its pole ends, or pole tips 67B, 67C offset laterally outwardly of the adjacent pole plate 69B, 69C to permit the inner pole ends to extend over the lateral side of the pole plates 69B, 69C in their attracted position to the inner pole ends 67B, 67C.

Mounted in the bottom of the breaker housing 1 is an arc extinction assembly which comprises an arc chute 110, an arc runner 115 extending along the inner bottom of the housing 1 in the contact separating direction and terminating in the bottom of the arc chute 110, and the arc drive member 116 extending vertically along the partition 4 and connected at its lower end to the arc runner 115. The arc runner 115 is integrally formed with the arc drive member 116 and is electricrally connected therethrough to the second contact arm 32 at 117. Once an arc is developed between the separating contacts 11 and 12 as seen in a rapid contact separation due to the overcurrent condition, one end of the arc is shifted from the second contact 12 onto the immediately adjacent portion of the arc runner 115 while the other end of the arc is on the first contact 11. As the first contact 11 travels along a path to its OFF position, the arc proceeds with the one end thereof anchored on the arc runner 115 into the arc chute 110 where it comes into contact with a stack of spaced arc shearing plates 112 to be extinguished thereat. The stack of the arc shearing plates 112 is supported by a holder 113 and disposed between the ends of the arc runner 115 and a horizontal plate 25 on the frame 21 of the switching mechanism 20.

When the arc is shifted to extend between the first contact 11 and the arc runner 115, the arc current will flow through A U-shaped path composed of the first contact arm 31, the arcing gap, the portion of the arc runner 115 and the arc drive member 116 extending generally in parallel relation to the first contact arm 31. Whereby electromagnetic repulsion forces are produced between the parallel conducting limbs of the U-shaped path and are concentrated on the arc to urge or drive it towards the arc chute 110 for rapid extinction of the arc. It is noted at this time that the arc drive member 116 constitutes the U-shaped arc current path instead of the second contact arm 32 upon the occurrence of the arc, keeping the second contact are 32 free from the arc current and protecting the second contact 12 from being damaged by the arc. This is particularly advantageous in that the second contact arm 32 can be selected solely in view of its conductivity and without regard to arc resistivity, and that the arc drive member 116 and the arc runner 115 can be selected mainly in view of its arc resistivity. To this end, the second contact arm 32 is made from a copper or its alloy having a superior conductivity while the arc runner 115 and the arc drive member 116 is made of an iron or ferro alloy having good heat resistivity but relatively great electric resistance. With the use of such material having relatively great electric resistance for the arc runner 115 and arc drive member 116, a considerable current limiting effect can be obtained upon the arc current flowing therethrough, thereby contributing to the extinction of the arc.

Figure 15:
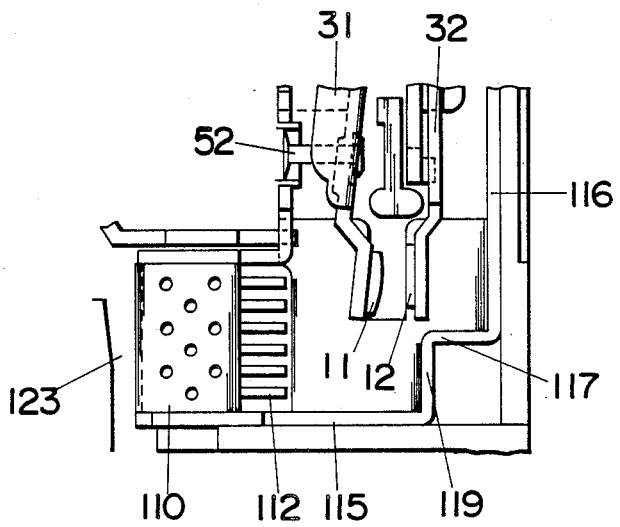
FIG. 15 is a partial front view illustrating an arc driving arrangement in a modification of the above embodiment.

For enhancing to shift the one end of the arc to the arc runner 115, a pilot extension 118 extends from the lower end of the second contact arm 32 in close proximity to the arc runner 115. For the same purpose, the connection between the arc runner 115 and the arc drive member 116 may be bent toward the lower end of the second contact arm 32, as seen in FIG. 15, a modification of the present embodiment. In this modification, a vertical segment 119 is formed in the connection between the arc runner 115 and the arc drive member 116 to extend in a position closer to the first contact arm 31 than the substantial portion of the arc drive member 116. Thus, the vertical segment 119 acts to exert the electromagnetic force for urging the arc towards the arc chute 110, in addition to that it serves as a barrier for blowing back an arc gas towards the arc chute 110.

Figure 14:
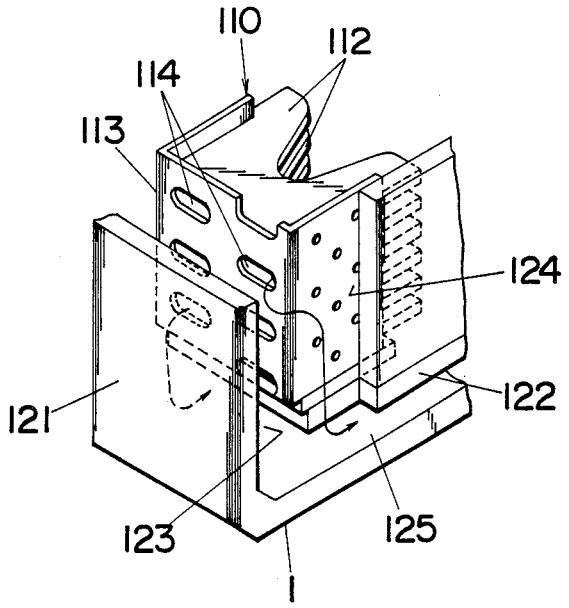
FIG. 14 is a partial perspective view of an arc extinguishing chute and its associated portion of the breaker housing.

For receiving the arc chute 110, there is formed in the lower portion of the housing 1 a chamber 120 which opens in the direction of the first and second contacts 11 and 12 and which is confined at its rear by a vertical rib 121, at its bottom by a horizontal rib 122, and at its opposite sides respectively by the housing 1 and the side cover 3. These ribs 121 and 122 are integral with the housing 1. The arc chute 110 is disposed in the chamber 120 with the rear wall of the holder 113 in spaced relation to the vertical rib 121 so as to form therebetween a space 123. As shown in FIG. 14, it is through this space 123 that escape ports 114 in the rear wall of the holder 113 communicate with an exhaust port 125 formed in the bottom wall of the housing 1 downwardly of the horizontal rib 122 for exhausting a volume of ionized gases produced by the arc reacting with its environments including the arc shearing plates 112. As seen in the figure, the side wall or the side cover 3 is notched to form on the rear portion of the side face of the arc chute 110 an additional space 124 which communicates rearwardly with the space 123 and downwardly with the exhaust port 125. Thus, the arc gas rushing out through the escape ports 114 can be routed through the spaces 124 and 125 along several flow courses as indicated by arrows in the figure toward the exhaust port 125 to be finally discharged outwardly of the housing 1. It is noted at this point that the vertical section of the partition 4 surrounding the electromagnet switch 60 acts as a barrier preventing the entry of the arc gas into the electromagnet 60 as well as to blow back the arc gas toward the arc chute 110 for expelling it through the escape ports 114.

Figure 16:
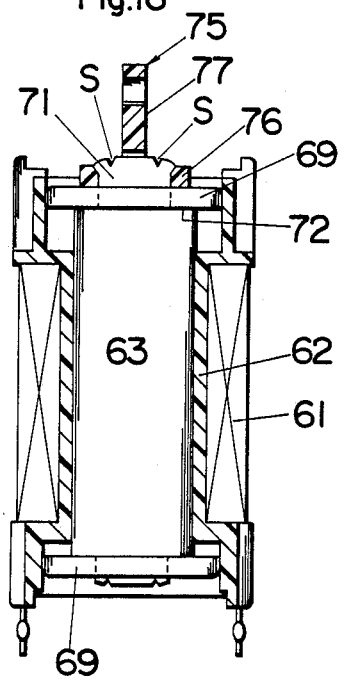
FIG. 16 is a front view illustrating the rigid connection between the plunger of the electromagnet and a joint for the second contact of the breaker.
Figure 17:
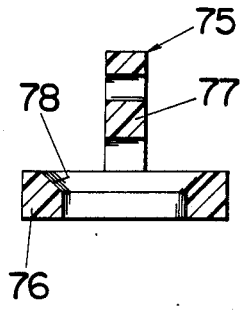
FIG. 17 is a sectional view of the joint utilized in FIG. 16.

FIG. 16 shows the connection of the plunger core 63 of the electromagnet 60 and the joint 75 utilized to couple the plunger core 63 to the horizontal member 81 of the L-shaped actuator 80. The joint 75 is made of a plastic material and comprises a square ring 76 and a tab 77 extending from the opposite sides of the ring 75, as shown in FIGS. 4 and 16, for pivotal connection by the pin 82 to the actuator 80. The ring 76 fits around a center stud 71 projecting from the upper end of the plunger core 63 with the upper pole plate 69 held between the ring 76 and a shouldered stop 72 on the upper end of the plunger core 63. After placing the ring 76 in position, the upper end of the stud 71 is struck at spaced points s by a suitable jig so as to partially deform the portion outwardly of the points S into engagement with a bevelled brim 78 formed around the inner periphery of the ring 76, thus rigidly connecting the joint 75 to the upper end of the plunger core 63 at the same time of connecting the pole plate 69 thereto.

Figure 18:
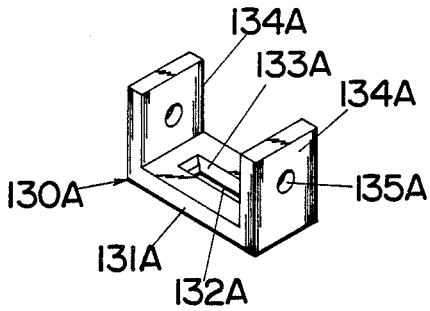
FIGS. 18 and 19 are respectively perspective views showing modifications of the joint utilized in FIG. 16.
Figure 19:
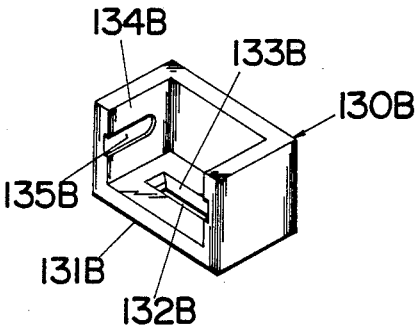

As shown in FIGS. 18 and 19, other types of joints 130A and 130B may be utilized instead of the joint 75. Each of the joint 130A and 130B comprises a base 131A, 131B with a pair of upward tabs 134A, 134B on the opposite sides thereof. The base 131A, 131B has in its center an aperture 132A, 132B with a beveled brim 133A, 133B around the upper edge thereof so that the upper end of the like plunger core extending through the aperture 132A, 132B can be partially deformed for engagement with the bevelled brim 133A, 133B in the like manner as described in the above. The tabs 134A and 134B are formed respectively with bearing holes 135A and bearing groove 135B for pivotal connection to the horizontal member of the L-shaped actuator by means of a pin.

What is claimed is:

1. A remotely controllable circuit breaker comprising:

a housing;

a breaker contact comprising first and second movable contacts;

a first contact arm carrying said first movable contact and movable between an OFF position and an ON position;

a second contact arm carrying at its end said second movable contact for contact with said first movable contact in said ON position, said second contact arm extending along said first contact arm in generally parallel relation thereto;

a switching mechanism for opening and closing said breaker contacts, said switching mechanism including a manual handle connected to move said first contact arm between said OFF position and said ON position, said switching mechanism further including trip means acting to forcibly move said first contact arm toward its OFF position from its ON position upon the occurrence of an overcurrent flowing through the circuit of the breaker;

and L-shaped actuator having a horizontal member and a vertical member and carrying on its vertical member said second contact arm, said actuator pivotally supported in the housing at a portion adjacent the connection between said horizontal member and vertical member for pivotal movement between an operative position where the second contact is allowed to be in contact with said first contact in said ON position and an inoperative position where said second contact is away from said first contact;

an electromagnet with an axially movable plunger and energizeable by a remote control signal for driving said plunger in its axial direction, said plunger being operatively connected to said horizontal member of the L-shaped armature so as to move the second contact arm between said operative and inoperative positions upon the energization and deenergization of said electromagnet, said electromagnet having length and width dimensions which are respectively parallel to and perpendicular to the axial direction of said plunger;

said electromagnet disposed in said housing in side-by-side relation to said switching mechanism with said first and second contact arms interposed therebetween;

said L-shaped actuator being disposed in proximity to said electromagnet with its horizontal member extending over the width of said electromagnet and with its vertical member extending over the length of said electromagnet such that said horizontal member and vertical member have their substantial portions, respectively, within the width and length dimensions of said electromagnet.

2. A remotely controllable circuit breaker as set forth in claim 1, wherein said second contact arm is pivotally supported at a point intermediate its ends to said vertical member of said L-shaped actuator for limited pivotal movement relative to said vertical member, said second contact arm being biased by a spring interposed between the second contact arm and the vertical member on the opposite side of the pivot point from said second movable contact for urging the second contact in the operative position into contact with said first contact in said ON position.

3. A remotely controllable circuit breaker as set forth in claim 1, wherein said first contact arm is pivotally supported about a first pivot axis positioned intermediate between the ends of said first contact arm and is operatively connected to said switching mechanism at its end opposite of said first pivot axis from the other end carrying said first movable contact.

4. A remotely controllable circuit breaker as set forth in claim 1, wherein said first contact arm is pivotally supported about a first pivot axis positioned intermediate between the ends of said first contact arm and is operatively connected to said switching mechanism at its end opposite of said first pivot axis from the other end carrying said first movable contact, and said trip means includes a magnetic coil with an axially movable release rod which extends through said coil to be magnetically coupled therewith and is connected at its end to said first contact arm, said magnetic coil connected in the circuit of the breaker in series relation to said first and second movable contacts such that it magnetically drives said release rod in the direction of disengaging said first contact in the ON position from said second contact upon the occurrence of an excess amount of current flowing through said magnetic coil, said release rod being connected to said first contact arm at a point between said first pivot axis and the first movable contact.

5. A remotely controllable circuit breaker as set forth in claim 1, further including an indicator which is movable together with said L-shaped actuator between two angularly displaced positions each indicative of each one of the operative and inoperative positions of said second contact arm, said indicator comprising a lever provided at its end with a display section which is viewed through a window in the housing, said indicator disposed adjacent to said L-shaped actuator with its portion opposite to said display section in an overlying relation to said vertical member of the L-shaped actuator and with the display section spaced outwardly therefrom, said lever being pivotally supported about a second pivot axis which is offset from the pivot axis of said L-shaped actuator in the direction away from said display section, said lever connected to said vertical member of said L-shaped actuator at a point opposite of said second pivot axis from the pivot axis of said L-shaped actuator so that the indicator is driven by said actuator to pivot about the second pivot axis between said two angularly displaced positions.

6. A remotely controllable circuit breaker as set forth in claim 1, wherein said second contact arm is connected through a conductor to a terminal located on the exterior of said housing on the opposite side of said electromagnet, said electromagnet accommodated in a cavity which is formed in the housing and surrounded by wall means on the inner surface of the housing and which has an opening through which said electromagnet is inserted, said opening of the cavity being fitted with a protective cover of an electrically insulative material so that said electromagnet is confined by said protective cover within the cavity, said protective cover having a grooved flange extending beyond said wall means outwardly of said cavity for receiving therein said conductor leading from said second contact arm to said terminal on the exterior of the housing.

* * * * *